US007175488B2

(12) United States Patent
Pavlovic et al.

(10) Patent No.: US 7,175,488 B2
(45) Date of Patent: Feb. 13, 2007

(54) ELECTRICAL CONNECTOR ASSEMBLY AND SYSTEM

(75) Inventors: Slobadan Pavlovic, Canton, MI (US); Reinhard Pusch, Stemwede (DE); Mohamad Zeidan, Dearborn Heights, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/907,502

(22) Filed: Apr. 4, 2005

(65) Prior Publication Data

US 2006/0223385 A1 Oct. 5, 2006

(51) Int. Cl.
*H01R 13/66* (2006.01)

(52) U.S. Cl. ..... 439/858; 439/620.27; 439/949

(58) Field of Classification Search ..... 439/621, 439/830, 833, 842, 858, 861, 949, 620.26–620.27
See application file for complete search history.

(56) References Cited

U.S. PATENT DOCUMENTS 3,659,243 A * 4/1972 Gluntz ..... 439/525
4,603,930 A * 8/1986 Ito ..... 439/78
4,992,062 A * 2/1991 Nakayama et al. ..... 439/621
6,015,302 A * 1/2000 Butts et al. ..... 439/76.2

FOREIGN PATENT DOCUMENTS

| | | |
|---|---|---|
| DE | 1868362 U | 3/1963 |
| GB | 1 047 590 | 11/1966 |
| GB | 1 266 108 | 3/1972 |
| GB | 2 111 768 A | 7/1983 |
| WO | WO 2004/086567 | 10/2004 |

* cited by examiner

*Primary Examiner*—X. Chung-Trans
(74) *Attorney, Agent, or Firm*—Brooks Kushman P.C.

(57) ABSTRACT

An electrical connector system having one or more electrical connector assemblies. The electrical connector assembly includes a blade and a spring clip. The spring clip is positioned around the blade and includes first and second portions. The first and second portions cooperate to exert a biasing force toward the blade. The first portion cooperates with the blade to define an insertion opening for receiving an electrical device.

20 Claims, 2 Drawing Sheets

ELECTRICAL CONNECTOR ASSEMBLY AND SYSTEM

BACKGROUND OF THE INVENTION

1. Field of the Invention

The present invention relates to an electrical connector assembly, and more particularly to an electrical connector assembly that may be part of an electrical connector system, such as that employed in a fuse block, junction block, or terminal block of a motor vehicle.

2. Background Art

Electrical connectors are known in the electrical connector assembly art, such as that disclosed in PCT Publication WO 2004/086567 A1.

SUMMARY OF THE INVENTION

According to one aspect of the present invention, an electrical connector assembly is provided. The electrical connector assembly includes a blade and a spring clip. The blade includes first and second ends and a notch disposed between the first and second ends. The spring clip is positioned around the blade and includes first, second, and radial portions. The radial portion includes an aperture and an engagement notch disposed proximate the aperture. The engagement notch contacts the notch on the blade to secure the spring clip. The first and second portions extend from the radial portion. The first and second portions each have a curved portion disposed proximate opposite sides of the blade. The first and second portions cooperate to exert a biasing force toward the blade. The first portion cooperates with the blade to define an insertion opening for receiving a contact of an electrical device.

The blade may include a mounting feature or may be integrally formed with another component, such as a busbar.

The blade may include first and second shoulders disposed proximate the notch. The first shoulder may include a tapered surface to facilitate assembly of the spring clip to the blade.

The blade and first portion of the spring clip may include first and second protrusions, respectively. The first and second protrusions may contact each other or opposite sides of the contact.

The spring clip may include inner and outer layers. The inner layer may be disposed proximate the blade and may have a higher conductivity than the outer layer. The outer layer may have a higher resilience than the inner layer.

The spring clip may include a tang disposed adjacent to the aperture and integrally formed with the second portion. At least a portion of the tang may be angled away from the blade.

According to another aspect of the present invention, an electrical connector system for a motor vehicle is provided. The electrical connector system includes a set of electrical connector assemblies disposed proximate a substrate. Each electrical connector assembly in the set may include a blade and a standardized spring clip. The set of electrical connectors assemblies may include an offset member and a non-offset member. The standardized spring clip of the offset member may be spaced further apart from the substrate than the standardized spring clip of the non-offset member to reduce installation effort when a contact of an electrical device is inserted into an insertion opening.

Each member of the set of electrical connector assemblies may include a blade that is integrally formed with the substrate. The blades of each member of the set of electrical connector assemblies may be generally coplanar.

Each standardized spring clip may include an inner layer disposed proximate the blade and an outer layer disposed adjacent to the inner layer. The inner layer may have a higher conductivity than the outer layer.

According to another aspect of present invention, an electrical connector assembly for a connection block of a motor vehicle is provided. The electrical connector system includes a set of electrical connector assemblies. Each member of the set of electrical connector assemblies includes a blade and a standardized spring clip. The blade includes a first end angled relative to a second end, and opposing notches disposed on opposite ends of the blade between the first and second ends. A first shoulder and a second shoulder are disposed adjacent to each opposing notch. The standardized spring clip includes first and second layers. The standardized spring clip also includes a radial portion and first and second arm portions integrally formed with the radial portion. The radial portion includes opposing engagement notches disposed proximate an aperture for securing the spring clip to the opposing notches on the blade. The first arm portion includes a first curved portion and a first end. The second arm portion includes a second curved portion and a second end. The first and second curved portions are disposed proximate opposite sides of the blade. The first and second ends are angled away from each other. The first portion cooperates with the blade to define an insertion opening. The insertion opening is adapted to receive a mating feature of an electrical device. The blade of each member of the set of electrical connector assemblies may be disposed proximate the electrical device.

DETAILED DESCRIPTION OF THE EMBODIMENT(S)

Figure 1:
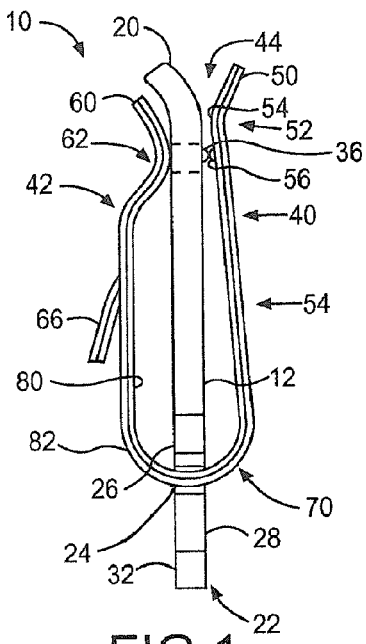
FIG. 1 is a perspective view of an embodiment of an electrical connector assembly.
Figure 2:
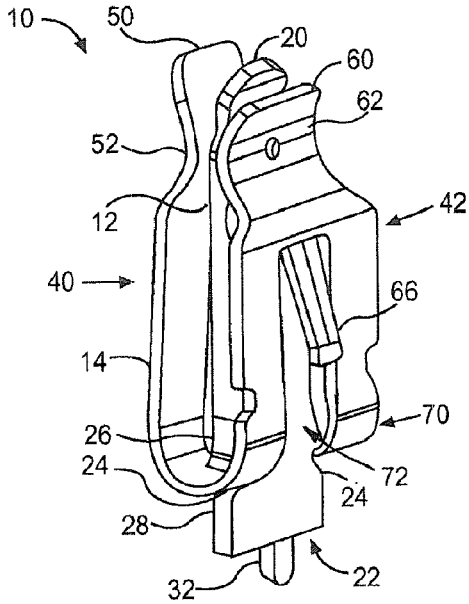
FIG. 2 is a side view of the electrical connector assembly shown in FIG. 1.
Figure 3:
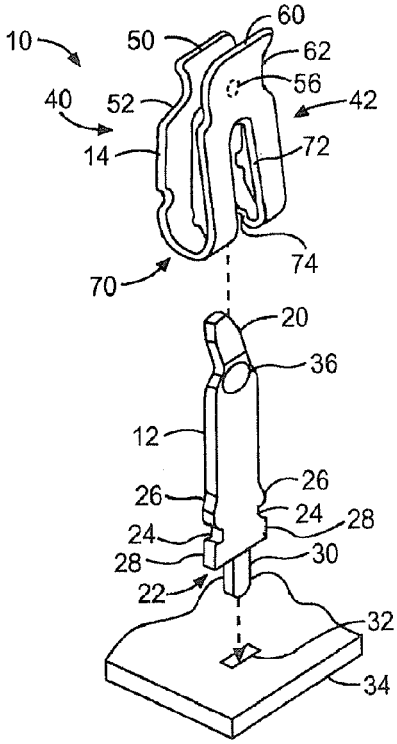
FIG. 3 is an exploded perspective view of the electrical connector assembly shown in FIG. 1 and a substrate.

Referring to FIGS. 1–3, one embodiment of an electrical connector assembly 10 is shown. The electrical connector assembly 10 includes a blade 12 and a spring clip 14.

The blade 12 may have any suitable configuration and may be made of any suitable conductive material, such as a metal like copper or a copper alloy. In the embodiment shown, the blade 12 is generally planar and includes first and second ends 20,22. The first end 20 may be angled, curved, or tapered to facilitate assembly with the spring clip 14 and to facilitate insertion of a mating portion of another electrical component as will be described in greater detail below.

The blade 12 may include one or more notches 24 disposed between the first and second ends 20,22. In the embodiment shown, two notches 24 are provided, each notch being disposed on opposing sides of the blade 12. The notches 24 facilitate engagement and retention of the spring clip 14 with the blade 12.

The notch or notches 24 may be disposed adjacent to first and second shoulders 26,28. In the embodiment shown, a first shoulder 26 is disposed between each notch 24 and the first end 20 and the second shoulder 28 is disposed between each notch 24 and the second end 22. The upper shoulder 26 may be tapered to facilitate assembly of the spring clip 14 to the blade 12. More specifically, the first shoulder 26 may be tapered such that it is wider proximate the notch 24 to allow the spring clip 14 to slide from the first end 20 toward the second end 22 during assembly and to help retain the spring clip 14 in the notch 24 when assembled. Alternatively, the present invention also contemplates other embodiments having shoulder configurations that permit the spring clip to be installed in the opposite direction. The lower shoulder 28 may also be tapered or may be provided without a taper as shown in FIG. 1.

The second end 22 may have various configurations. In one embodiment, the second end 22 includes a mounting feature 30. The mounting feature 30 may have a male or a female configuration. In the embodiment shown in FIGS. 1–3, the mounting feature 30 has a male configuration that is adapted to engage a mounting aperture 32 disposed in a substrate 34, such as a busbar, contact, or printed circuit board like that shown in FIG. 3. Alternatively, the second end 22 may be integrally formed with the substrate 34, thereby making the mounting feature 30 unnecessary.

The blade 12 may also include a protrusion 36. The protrusion 36 may be disposed in any suitable location, such as on a side of blade 12. The protrusion 36 may contact an electrical component inserted into the electrical connector assembly 10 and may contact the spring clip 14 when an electrical component is not received in the electrical connector assembly 10. The protrusion 36 may have any suitable configuration. In the embodiment shown, the protrusion 36 has a rounded or curved surface that helps reduces installation effort of an electrical component.

The spring clip 14 may have any suitable configuration. In the embodiment shown, the spring clip 14 includes a first portion 40 and a second portion 40. The first and second portions 40,42 are generally disposed on opposite sides of the blade 12 when the blade 12 and spring clip 14 are assembled.

The first portion 40 cooperates with the blade 12 to define the insertion opening 44. In the embodiment shown, the first portion 40 includes an end 50 that is angled or curved away from the first end 20 of the blade 12 to increase the size of the insertion opening 44 and to facilitate insertion of an electrical component.

The first portion 40 may also include a curved section 52 having an inner surface 54 and a protrusion 56. In the embodiment shown, the protrusion 56 extends from the inner surface 54 proximate the curved section 52. The protrusion 56 may engage the protrusion 36 disposed on the blade 12 when an electrical component is not inserted into the electrical connector assembly 10. Moreover, the protrusion 56 and/or curved section 52 may exert force to help secure an electrical component inserted in the electrical connector assembly 10.

The second portion 42 may also include an end 60 and a curved section 62. The end 60 may be angled or curved away from the end 50 of the first portion 40 to facilitate installation of the blade 12 into the spring clip 14. The curved section 62 may be configured to contact the blade 12 and transmit force to the blade to help secure an electrical component.

The curved sections 52,62 may be spaced apart from each other before installation with the blade 12. The amount of spacing or gap size may be any suitable amount. For instance, the ratio of the blade thickness to the curved section gap size may be approximately 3 to 1.

The second portion 42 may also include a tang 66 that extends outwardly or away from the blade 12. The tang 66 may be adapted to engage another component, such as a mounting boss or portion of a junction or terminal block, to facilitate positioning and attachment of the electrical connector assembly 10.

The first and second portions 40,42 may be connected along a curved or radius portion 70 that promotes biasing of the spring clip 14 toward the blade 12. The radius portion 70 may include an aperture 72 and one or more engagement notches 74. In the embodiment shown, engagement notches 74 are provided on opposite sides of the aperture 72. The engagement notches 74 are adapted to engage the blade notches 24 when the electrical connector assembly 10 is assembled.

The spring clip 14 may be made of any suitable material. In addition, the spring clip 14 may include one or more layers. In the embodiment shown in FIG. 2, the spring clip 14 includes an inner layer 80 and an outer layer 82.

The layers 80,82 may be provided in any suitable manner, such as by using a clad material or applying one or more additional layers as a coating using any suitable technique as is known by those skilled in the art. In addition, a plurality of layers may be provided on a portion of the blade 12 and/or spring clip 14. For example, the inner layer 70 may be provided on the first and/or second portions 50,52. In the embodiment shown, the inner layer 70 is provided on the first and second portions 50,52 to simplify manufacturing and improve electrical conductivity between the blade 12 and the spring clip 14.

Layered construction allows materials to be tailored to environmental conditions and performance requirements. For example, the inner layer 80 may be selected to provide a desired level of electrical and/or thermal conductivity while the outer layer 82 may be selected to provide desired mechanical properties. In one embodiment, the inner layer 80 may be made of a metal like copper that has favorable conductive properties while the outer layer 82 may be made of another metal like steel or stainless steel to provide spring resilience. Moreover, layered construction may be desirable in high temperature environments, such as those associated with high current loads or automotive applications.

Layered construction also reduces the performance tradeoffs associated with a single material layer. For example, a layered copper/steel structure provides superior electrical and mechanical performance in high temperature environments as compared to high temperature copper alloys such as those made of copper and beryllium (CuBe), which are costly and environmentally unfriendly.

Figure 4:
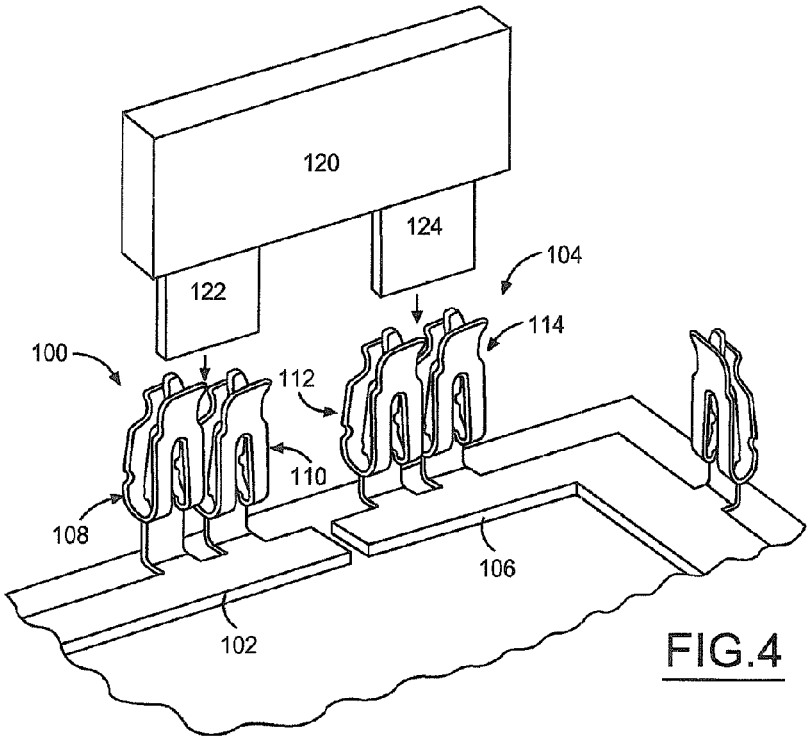
FIG. 4 is a perspective view of a plurality of electrical connector assemblies integrally formed with a substrate.

Referring to FIG. 4, a plurality of electrical connector assemblies are shown. The plurality of electrical connector assemblies may be used as standardized termination elements associated with a busbar, carrier blade, printed circuit board, fuse block, junction block, or terminal block. In this embodiment, a first set 100 of electrical connector assemblies is disposed proximate a first busbar 102 and a second set of electrical connector assemblies 104 is disposed proximate a second busbar 106. The first set 100 includes first and second electrical connector assemblies 108,110 and the second set 104 includes third and fourth electrical connector assemblies 112,114. Alternatively, each set may include a different number of electrical connector assemblies. For example, additional electrical connector assemblies may be employed with larger electrical components or larger blade terminals to provide more contact surface to accommodate different power requirements and/or to provide a desired amount of retention force.

The electrical connector assemblies may receive a contact of an electrical component 120, such as a blade terminal. In the embodiment shown in FIG. 4, the electrical component 120 is configured as a circuit protection device, such as a fuse or relay and includes first and second contacts 122,124. The first and second contacts 122,124 are adapted to be received by the first and second sets of electrical connectors 100,104, respectively. Insertion of the electrical component 120 may be accomplished by positioning the electrical component 120 in the first and second sets 100,104 in the direction denoted by the arrows.

The members of the first and/or second sets 100,104 may be offset or staggered from each other to reduce installation force. More particularly, one or more electrical connector assemblies associated with a particular contact, such as the first and second electrical connector assemblies 108,110 may be offset such that the contact point of their blades and spring clips are not aligned. An offset may be achieved by providing generally coplanar blade portions having different lengths. Moreover, a common spring clip may be employed with an offset blade construction. An offset construction positions the peak installation force points at different locations, thereby reducing the maximum installation force as compared to a non-offset configuration. The members of a set of electrical connector assemblies may be offset by any suitable distance that is compatible with the electrical component it receives. In addition, any suitable offset configuration may be employed. For example, the offset configuration shown in FIG. 4 may be reversed so that the first electrical connector assembly 108 may be disposed closer to the busbar than the second electrical connector assembly 110.

Figure 5:
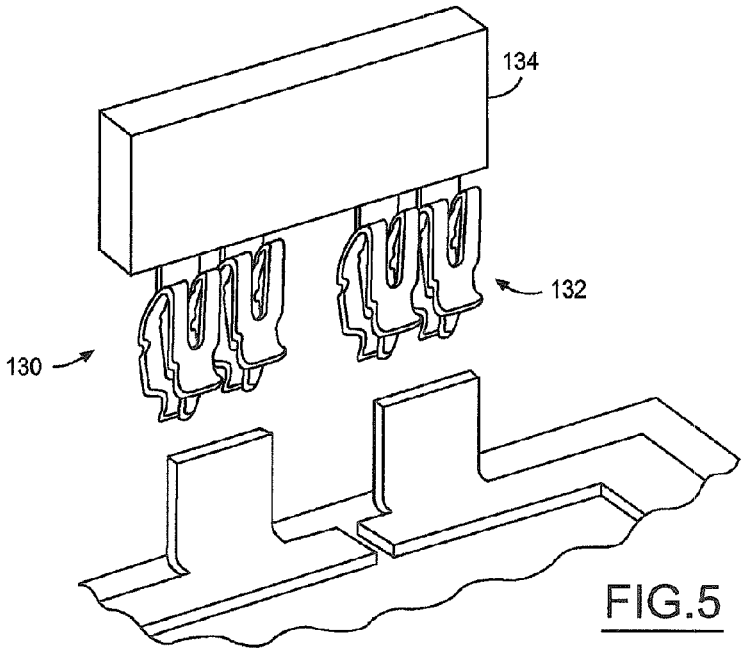
FIG. 5 is a perspective view of a plurality of electrical connector assemblies disposed proximate a circuit protection device.

Referring to FIG. 5, another embodiment of an electrical connector system is shown. In this embodiment, one or more sets of electrical connector assemblies 130,132 are disposed proximate an electrical component 134, such as those previously described. The sets of electrical connector assemblies 130,132 receive mating features of another electrical component, such as a blade terminal, to make an electrical connection. One or more electrical connector assemblies may be associated with each electrical component or blade terminal and may have an offset configuration as previously described.

The electrical connector assembly may be made in any suitable manner. For instance, the blade 12 may be made by stamping, cutting, or casting. An integrally formed blade may fabricated with an associated substrate, such as a busbar, and folded to a desired orientation. Similarly, the spring clip 14 may be stamped, cut, or cast, and folded to a desired shape, if necessary. After the blade 12 and spring clip 14 are fabricated, the electrical connector assembly may be assembled in any suitable manner. For example, the blade 12 and spring clip 14 may be assembled in a stamping die used to fabricate either component. Alternatively, the blade 12 and spring clip 14 may be assembled after the blade 12 is assembled to a substrate or installed in a fuse, junction, or terminal block.

The present invention allows electrical connector assemblies and/or their components to be standardized. Standardization reduces manufacturing costs, complexity, and potential quality issues, such as those associated with misassembly of non-standardized components. Moreover, the present invention allows standardized connectors to be used to accommodate electrical connections having different sized termination elements and/or different current levels. In addition, insertion forces may be reduced by offsetting members of a set of electrical connector assemblies relative to each other. Furthermore, the present invention allows a plurality of materials or material layers to be provided to improve electrical and/or mechanical performance. The present invention also allows an electrical connector to be provided on a standardized component without requiring material alterations. For instance, a spring clip may be provided on a standard busbar or blade terminal that is made of a highly conductive material like copper, while the spring clip may be made of another material like steel that is suited for a particular application environment and/or mechanical performance level. Moreover, the present invention may be implemented without increasing space requirements, which is desirable in motor vehicles or other applications sensitive to package space limitations.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An electrical connector assembly, comprising:

a blade including:

first and second ends, and a notch disposed between the first and second ends; and a spring clip positioned around the blade, the spring clip including:

a radial portion having an aperture and an engagement notch disposed proximate the aperture, the engagement notch contacting the notch to secure the spring clip to the blade, and first and second portions extending from the radial portion, the first and second portions each having a curved portion disposed proximate opposite sides of the blade that cooperate to exert a biasing force toward the blade;

wherein the first portion cooperates with the blade to define an insertion opening for receiving a contact of an electrical device.

2. The electrical connector assembly of claim 1 wherein the blade is integrally formed with a busbar.

3. The electrical connector assembly of claim 1 wherein the blade further comprises first and second shoulders disposed proximate the notch.

4. The electrical connector assembly of claim 3 wherein the first shoulder includes a tapered surface to facilitate assembly of the spring clip to the blade.

5. The electrical connector assembly of claim 1 wherein the spring clip includes inner and outer layers, the inner layer being disposed proximate the blade.

6. The electrical connector assembly of claim 5 wherein the inner layer has higher conductivity than the outer layer.

7. The electrical connector assembly of claim 5 wherein the outer layer has higher resilience than the inner layer.

8. The electrical connector assembly of claim 1 wherein the blade includes a first protrusion disposed between the first end and the notch and the first portion includes a second protrusion, the first and second protrusions engaging opposite sides of the contact when the electrical device is inserted into the insertion opening and disposed proximate each other when the electrical device is not inserted into the insertion opening.

9. The electrical connector assembly of claim 1 wherein the spring clip further comprises a tang disposed adjacent to the aperture and integrally formed with the second portion, at least a portion of the tang being angled away from the blade.

10. The electrical connector assembly of claim 1 wherein the second end further comprises a mounting feature for engaging a mounting aperture disposed in a substrate.

11. An electrical connector system for a motor vehicle, comprising:

a set of electrical connector assemblies disposed proximate a substrate, each electrical connector assembly including:

a blade having opposing notches disposed between first and second ends, and a standardized spring clip having a radial portion including opposing engagement notches disposed proximate an aperture for securing the spring clip to the blade, and first and second arm portions integrally formed with the radial portion, the first and second arm portions having curved portions disposed proximate opposite sides of the blade, the first arm portion cooperating with the blade to define an insertion opening for receiving a contact of an electrical device;

wherein the set of electrical connector assemblies includes an offset member and a non-offset member, the standardized spring clip of the offset member being spaced further apart from the substrate than the standardized spring clip of the non-offset member to reduce installation effort when the contact is inserted into the insertion openings.

12. The electrical connector system of claim 11 wherein each member of the set of electrical connector assemblies includes a blade that is integrally formed with the substrate.

13. The electrical connector system of claim 12 wherein the substrate is a busbar.

14. The electrical connector system of claim 13 wherein the substrate is disposed proximate a connector block.

15. The electrical connector system of claim 11 wherein the electrical device is a fuse.

16. The electrical connector system of claim 11 wherein the blades of each member of the set of electrical connector assemblies are generally coplanar.

17. The electrical connector system of claim 11 wherein each standardized spring clip includes an inner layer disposed proximate the blade and an outer layer disposed adjacent to the inner layer, the inner layer having higher conductivity than the outer layer.

18. An electrical connector system for a connection block of a motor vehicle, comprising:

a set of electrical connector assemblies, each electrical connector assembly including:

a blade having a first end angled relative to a second end and opposing notches disposed on opposite sides of the blade between the first and second ends, each opposing notch being disposed adjacent to a first shoulder and a second shoulder, and a standardized spring clip having first and second layers, a radial portion for providing a spring biasing force, opposing engagement notches disposed proximate an aperture of the radial portion for securing the spring clip to the opposing notches on the blade, and first and second arm portions integrally formed with the radial portion, the first arm portion having a first curved portion and a first end and the second arm portion having a second curved portion and a second end, the first and second curved portions being disposed proximate opposite sides of the blade, the first and second ends being angled away from each other, and the first portion cooperating with the blade to define an insertion opening;

wherein the insertion opening is adapted to receive a mating feature of another electrical device.

19. The electrical connector system of claim 18 wherein the set of electrical connector assemblies includes an offset member and a non-offset member, the standardized spring clip of the offset member being spaced further apart from the substrate than the standardized spring clip of the non-offset member to reduce installation effort when the set of electrical assemblies receives the mating feature.

20. The electrical connector system of claim 18 wherein the blade of each member of the set of electrical connector assemblies is disposed proximate the electrical device and the insertion opening receives a mating feature disposed proximate a busbar.

* * * * *